US005680939A

United States Patent [19]

Oliver

[11] Patent Number: 5,680,939

[45] Date of Patent: Oct. 28, 1997

[54] GROUND ENGAGABLE GUN SUPPORT

[76] Inventor: John W. Oliver, 45169 State Rte. 46, New Waterford, Columbia County, Ohio 44445

[21] Appl. No.: 687,050

[22] Filed: Aug. 7, 1996

[51] Int. Cl.[6] ..... A47F 7/00

[52] U.S. Cl. ..... 211/64; 248/156; 248/161

[58] Field of Search ..... 211/64; 248/156, 248/161, 411, 413, 415

[56] References Cited

U.S. PATENT DOCUMENTS

| | | | |
|---|---|---|---|
| 3,007,581 | 11/1961 | Moore . | |
| 3,477,586 | 11/1969 | Haluska . | |
| 3,876,078 | 4/1975 | Gomes et al. . | |
| 3,917,071 | 11/1975 | Walters . | |
| 3,952,878 | 4/1976 | Gorham . | |
| 4,089,423 | 5/1978 | Gorham et al. . | |
| 4,144,971 | 3/1979 | Balibrea . | |
| 4,271,969 | 6/1981 | Gnesa . | |
| 4,318,567 | 3/1982 | Guthier | 248/156 X |
| 5,626,379 | 5/1997 | Scott | 211/64 X |

*Primary Examiner*—Robert W. Gibson, Jr.
*Attorney, Agent, or Firm*—Frederic E. Naragon

[57] ABSTRACT

A ground engagable gun support apparatus comprising a main elongated tube and an adjustable elongated tube slidably attached to the main elongated tube by a pair of stabilizing bars and securing means and adjustable vertically and rotatably about the main elongated tube with a butt support tray at the lower end of the elongated tube and a generally "Y" shaped barrel support bracket attached at the upper end of the adjustable elongated tube to receive and support the butt and barrel of the gun respectively, and a strap affixed to the main elongated tube for carrying and camouflage coloring of the invention providing for the non-detectibility by game when employed by the user in the field or safety coloring for visibility in the field.

3 Claims, 3 Drawing Sheets

GROUND ENGAGABLE GUN SUPPORT

BACKGROUND OF THE INVENTION AND SUMMARY OF THE INVENTION

The present invention relates generally to a gun support or rest that is useable to support a rifle or a shotgun, and particularly a gun with a scope, and the gun is supported on its butt in a generally vertical position. A pair of generally parallel tubes are used as the support and the lower end of the first or main elongated tube has a ground-insertible spike and a generally horizontal stabilizing bar which will engage the surface of the ground and the bar can be also engaged by the user's foot to aid in the insertion of the lower end of the spike into the ground. The second or adjustable elongated tube is slidably attachable to the main elongated tube by a pair of stabilizer bars and securing means and the adjustable elongated tube is slidable vertically with respect to the main elongated tube and rotatable about the axis of the main elongated tube. The adjustable elongated tube has a butt support tray at its lower end adapted to receive and support the butt of a rifle or shotgun and a generally "Y" shaped barrel support bracket attached at the upper end of the adjustable elongated tube adapted to receive and support the barrel of the rifle or shotgun. A strap is provided and affixed to the main elongated tube at both ends by strap latches for use in transporting the present invention. The invention provides exceptional advantages when in use by hunters or target shooters since the invention holds the rifle or shotgun while the user is waiting for game or waiting to shoot and also keeps the gun off of the ground and thus keeps the gun dry and readily accessible. The invention may also be colored for camouflage and thus not detectible by game when employed by a hunter in the field or may be safety colored such as hunter's orange for visibility in the field.

The prior art discloses patents for gun support apparatus and some of the patents of the prior art are listed as follows:

| | | | |
|---|---|---|---|
| U.S. Pat. | 3,007,581 | Benjamin F. Moore | Nov. 7, 1961 |
| U.S. Pat. | 3,477,586 | Lawrence Haluska | Nov. 11, 1969 |
| U.S. Pat. | 3,876,078 | Manuel A. Gomes, et al. | Apr. 8, 1975 |
| U.S. Pat. | 3,917,071 | Russell W. Walters | Nov. 41 1975 |
| U.S. Pat. | 3,952,878 | Jack R. Gorham | Apr. 27, 1976 |
| U.S. Pat. | 4,089,423 | Jack R. Gorham, et al. | May 16, 1978 |
| U.S. Pat. | 4,144,971 | Gabriel K. Balibrea | Mar. 20, 1979 |
| U.S. Pat. | 4,271,969 | Edward C. Gnesa | Jun. 9, 1981 |

U.S. Pat. No. 3,007,581 issued to Benjamin F. Moore on Nov. 7, 1961, pertains to a ground insertible duck hunter's crutch which may be also used as a gun support. However, the invention does not disclose a two-tube structure wherein one tube is slidably adjustable vertically and rotatably adjustable horizontally to support a gun, nor does the invention disclose a carrying strap, stabilizing bar, or camouflage or safety coloring as is provided in the present invention.

U.S. Pat. No. 3,477,586 issued to Lawrence Haluska on Nov. 11, 1969, pertains to a portable gun rack adapted for carrying in an automobile and does not provide for ground insertion, adjustability, a two elongated tube structure, carrying strap, stabilizing bar, or camouflage or safety coloring as is provided in the present invention.

U.S. Pat. No. 3,876,078 issued to Manuel A. Gomes, et al. on Apr. 8, 1975, pertains to a portable gun rack but does not provide for ground insertion of the invention nor a two-tubed adjustable structure, camouflage or safety coloring, carrying strap, barrel and butt supports, or a stabilizing bar as is provided in the present invention.

U.S. Pat. No. 3,917,071 issued to Russell W. Walter on Nov. 4, 1975, pertains to a weapon security rack for securing a weapon from unauthorized removable and provides for a butt housing and barrel mount but does not provide for ground insertion of the invention nor does the invention pertain to a two-tubed structure, camouflage or safety coloring, carrying strap, stabilizing bar, or adjustability as is provided in the present invention.

U.S. Pat. No. 3,952,878 issued to Jack R. Gorham on Apr. 27, 1976, pertains to an earth engagable gun rack and provides a collapsible apparatus and a butt and barrel support means. The invention does not disclose the two-elongated tube structure which is adjustable vertically and rotatably nor does the invention disclose a stabilizing bar, carrying strap, camouflage or safety coloring and does not disclose the ability to hold a rifle or shotgun with a scope as is provided in the present invention.

U.S. Pat. No. 4,089,423 issued to Jack R. Gorham, et al. on May 16, 1978, pertains to a foldable and collapsible rifle stand with an earth engaging spike and gun butt support and plate. The invention does not provide for a carrying strap, a two-tubed adjustable structure, camouflage or safety coloring, or stabilizing bar as is provided in the present invention.

U.S. Pat. No. 4,144,971 issued to Gabriel K. Balibrea on Mar. 20, 1979, pertains to an earth engagable gun stand with a rigid support shaft and a plurality of stake members but does not disclose a two-tubed adjustable structure, carrying strap, stabilizing bar, or camouflage or safety coloring as is provided in the present invention.

U.S. Pat. No. 4,271,969 issued to Edward C. Gnesa on Jun. 9, 1981, pertains to a long-barrel firearm stand with gun butt support plate and an adjustable apparatus to engage the barrel of the long-barrel firearm but does not provide for a carrying strap, stabilizing bar, two-tubed adjustable structure or camouflage or safety coloring as is provided in the present invention.

Therefore, the present invention provides a new and improved ground engagable gun support which has all the advantages of the prior art gun supports and none of the disadvantages. Further, the present invention may be easily and efficiently manufactured and marketed at low cost and readily affordable to the buying public. A more detailed understanding of the present invention and its uses may be attained by examination of the accompanying drawings and descriptive matter in which the embodiment of the invention is illustrated.

BRIEF DESCRIPTION OF THE DRAWINGS

For a better understanding of the invention reference should be made to the accompanying drawings wherein.

ABSTRACT OF THE DRAWINGS

Figure 1:
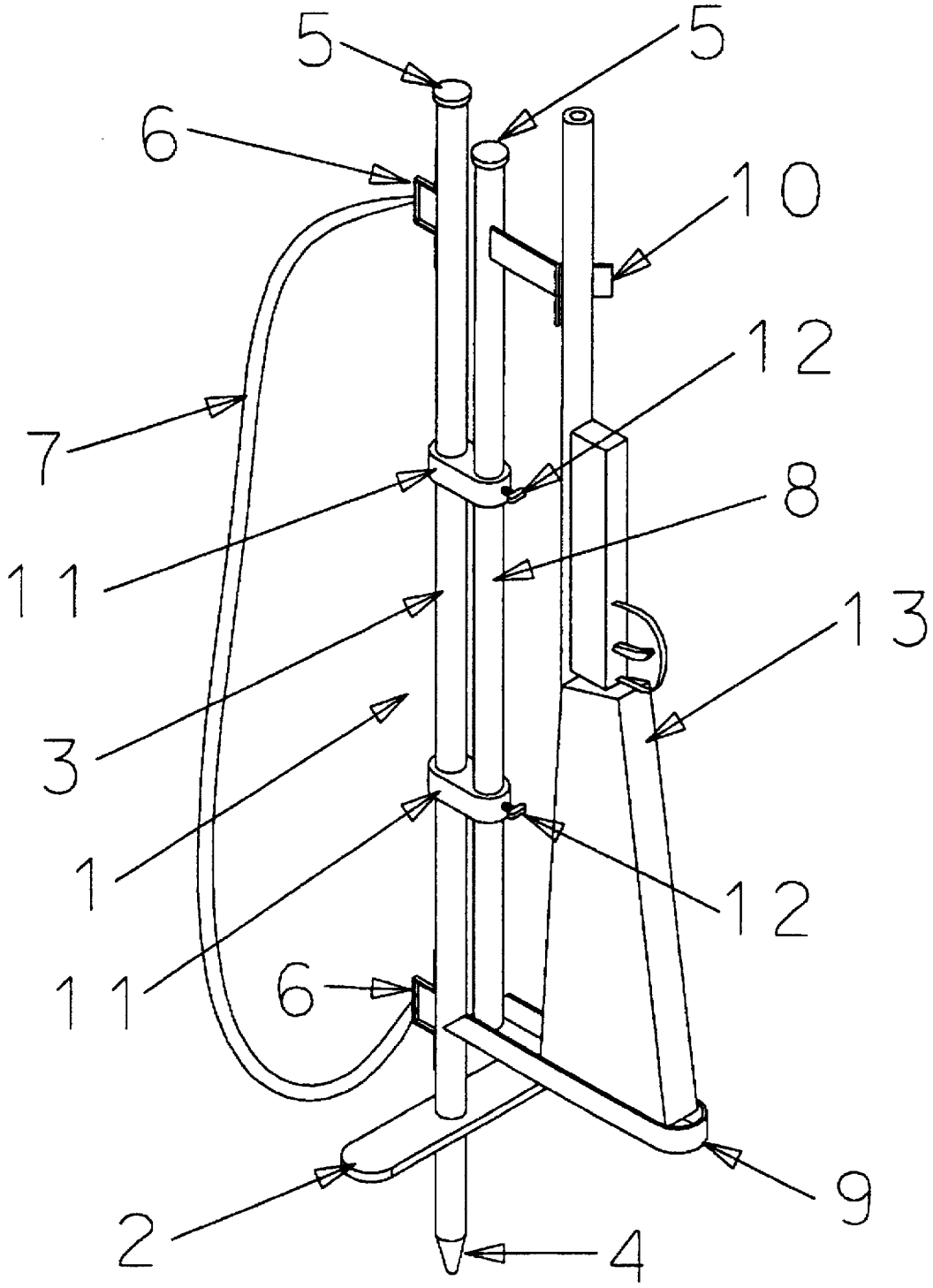
FIG. 1 is a perspective view of the present invention with a rifle in position on the present invention.

1 is the present invention;

2 is a stabilizing bar;

3 is a main elongated tube;

4 is a spiked end;

5 is a protection cap;

6 is a strap latch;

7 is a strap;

8 is an adjustable elongated tube;

9 is a butt support tray;

10 is a barrel support bracket;

11 is a stabilizer bracket;

12 is a securing mean;

13 is a rifle.

DETAILED DESCRIPTION OF THE DRAWINGS

Reference is now made to the drawings wherein the present invention is illustrated in detail and wherein similar components bear the same reference numeral throughout the several views.

FIG. 1 shows a perspective view of the present invention 1 with a rifle 13 in position on the present invention 1 and further illustrates stabilizing bar 2, main elongated tube 3, spiked end 4, protection caps 5, strap latches 6, strap 7, adjustable elongated tube 8, butt support tray 9, barrel support bracket 10, stabilizer bracket 11, and securing means 12.

Figure 2:
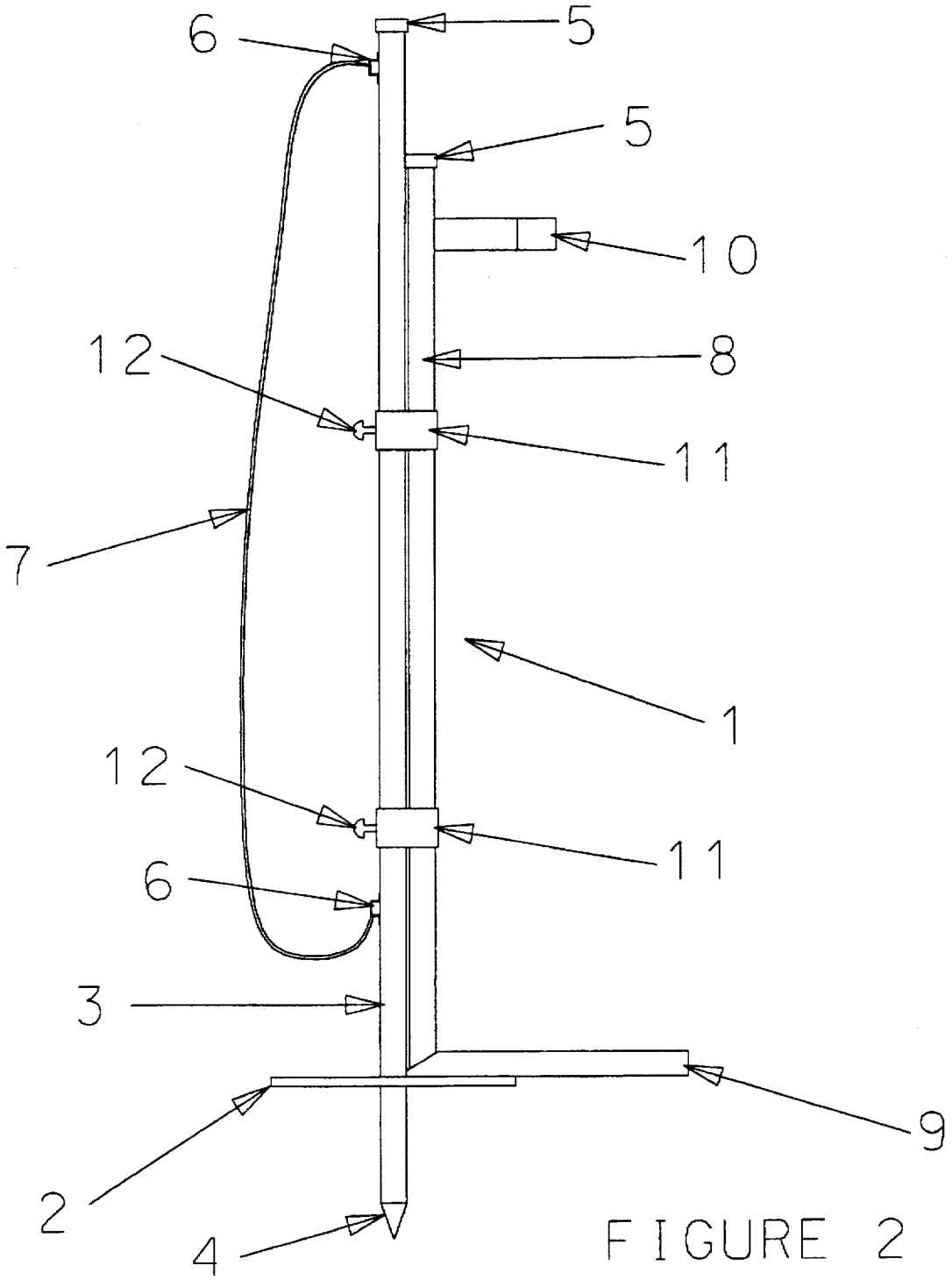
FIG. 2 is a side view of the present invention.

FIG. 2 is a side view of the present invention 1 and further illustrates stabilizing bar 2, main elongated tube 3, spiked end 4, protection caps 5, strap latches 6, strap 7, adjustable elongated tube 8, butt support tray 9, barrel support bracket 10, stabilizer bracket 11, and securing means 12.

Figure 3:
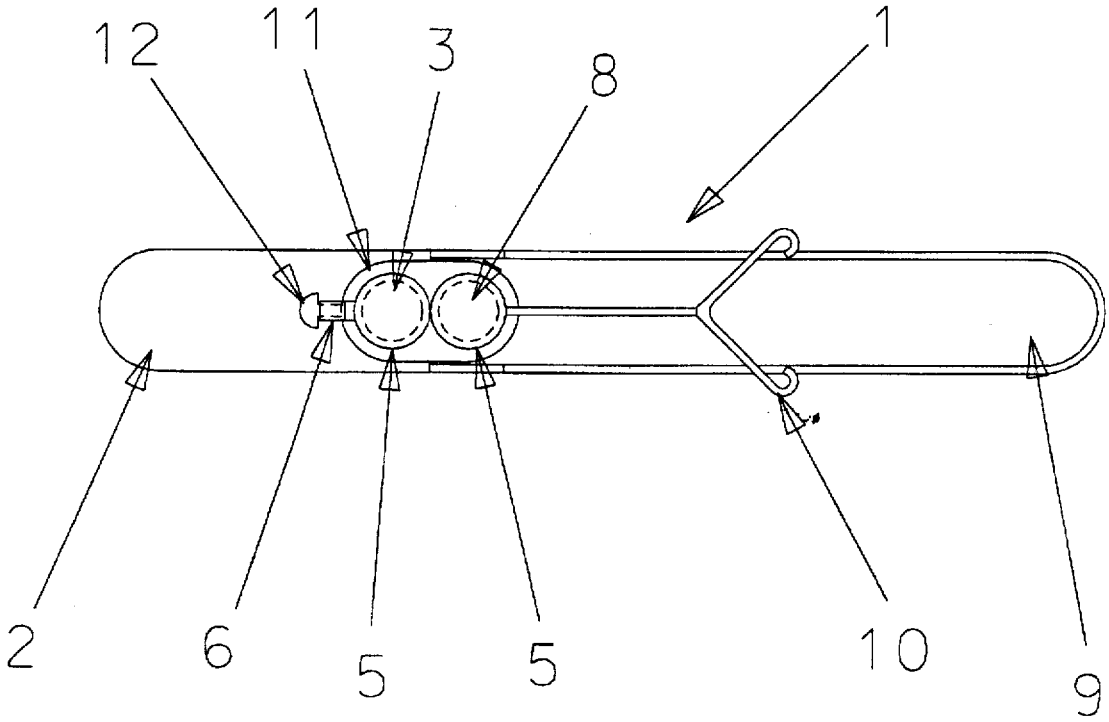
FIG. 3 is a top view of the present invention.

FIG. 3 is a top view of the present invention 1 and further illustrates stabilizing bar 2, main elongated tube 3, protection caps 5, strap latch 6, adjustable elongated tube 8, butt support tray 9, barrel support bracket 10, and stabilizer bracket 11, and securing means 12.

DESCRIPTION OF THE PREFERRED EMBODIMENT

Referring to FIGS. 1 through 3 the preferred embodiment of the present invention comprises a ground engagable gun support apparatus that is useable to support a rifle or shotgun, particularly a gun with a scope and the gun is supported on its butt in a generally vertical position. A pair of generally parallel tubes are used as the support and the lower end first or main elongated tube has a ground insertible spike and a generally horizontal stabilizing bar which will engage the surface of the ground and the bar can also be engaged by the user's foot to aid in the insertion of the lower end of the spike into the ground. The second or adjustable elongated tube is adapted to slidably attach to the main elongated tube by a pair of stabilizing bars and securing means and the adjustable elongated tube is slidable vertically with respect to the main elongated tube and rotatable about the axis of the main elongated tube, to provide for adjustment by height and horizontally for the gun being supported. The adjustable elongated tube has a butt support tray at its lower end adapted to receive and support the butt of a rifle or shotgun and a generally "Y" shaped barrel support bracket attached at the upper end of the adjustable elongated tube adapted to receive and support the barrel of the rifle or shotgun. A strap is provided and affixed to the main elongated tube at both ends by strap latches for use in transporting and carrying the present invention. In addition and in preferred form, the invention is colored for camouflage and thus not detectible by game when employed by a hunter in the field. In the preferred embodiment the present invention may be manufactured from light weight material such as aluminum or plastic or any similar material and the securing means to secure the adjustable elongated tube in position on the main elongated tube are thumbscrews in preferred form.

Although the invention has been described in preferred form with a certain degree of particularity, it is understood that the present disclosure of the preferred form has been made only by way of example and numerous changes in the details of construction and the combination arrangement of parts may be resorted to without departing from the spirit and scope of the invention as hereinafter claimed.

What is claimed is:

1. A ground insertable gun support apparatus useable to support a long barrel gun in a generally vertical position and comprising: a two-ended main elongated tube with a spike disposed at one end for insertion into the ground, a stabilizing bar disposed generally perpendicular to the main elongated tube near the spike end to engage the surface of the ground to stabilize the apparatus and to be engaged by the user's foot to aid in insertion of the apparatus into the ground, a two-ended adjustable elongated tube adapted to slidably attach to the main elongated tube by a pair of stabilizer brackets and adapted to allow the adjustable elongated tube to slidably adjust vertically up and down to the main elongated tube and to adjust horizontally by rotation about the axis of the main elongated tube, a pair of stabilizer brackets secured to the main elongated tube and spaced along the main elongated tube and adjustably secured to the adjustable elongated tube by securing means to allow the adjustable elongated tube to adjust vertically with the main elongated tube and adjustable horizontally by rotating about the axis of the main elongated tube, securing means disposed in each stabilizer bracket to secure the adjustable elongated tube in desired position on the main elongated tube, a butt support tray disposed generally perpendicular at one end of the adjustable elongated tube at the end in proximity with the spike end of the main elongated tube and adapted to accept and support the butt of the gun in use, a barrel support bracket of generally "Y" shape disposed at the other end of the adjustable elongated tube to accept and support the barrel of the gun in use and to cooperate with the butt support tray in supporting the gun in a generally vertical position, a pair of strap latches secured to each end of the main elongated tube adapted to accept a strap, and a strap secured to the pair of strap latches adapted for transporting the apparatus.

2. The invention of claim 1 wherein the apparatus is camouflage colored.

3. The invention of claim 1 wherein the apparatus is safety colored.

* * * * *